US005217118A

United States Patent [19]

Mochizuki et al.

[11] Patent Number: 5,217,118

[45] Date of Patent: Jun. 8, 1993

[54] PACKAGED ARTICLE

[75] Inventors: Akira Mochizuki; Kazuhiko Makita, both of Fujinomiya; Toshikazu Kawai; Kaoru Watanabe, both of Tokyo, all of Japan

[73] Assignee: Terumo Kabushiki Kaisha, Tokyo, Japan

[21] Appl. No.: 800,489

[22] Filed: Nov. 29, 1991

[30] Foreign Application Priority Data

Nov. 30, 1990 [JP] Japan ..... 2-334425

[51] Int. Cl.[5] ..... B65D 85/84; B65D 81/20; B65D 81/24

[52] U.S. Cl. ..... 206/524.2; 206/205; 206/524.8; 206/587

[58] Field of Search ..... 206/524.2, 587, 524.8, 206/525, 564, 205

[56] References Cited

U.S. PATENT DOCUMENTS

| | | | |
|---|---|---|---|
| 4,098,404 | 7/1978 | Markert | 206/524.8 |
| 4,150,744 | 4/1979 | Fennimore | 206/524.8 |
| 4,295,566 | 10/1981 | Vincek | 206/524.8 |
| 4,497,406 | 2/1985 | Takanashi | 206/524.2 |
| 4,537,305 | 8/1985 | Takanashi | 206/524.2 |
| 4,730,726 | 3/1988 | Holzwarth . | |
| 4,756,421 | 7/1988 | Meek | 206/524.2 |
| 4,765,463 | 8/1988 | Chanel | 206/524.8 |
| 4,874,656 | 10/1989 | Rantanen | 206/524.2 |

FOREIGN PATENT DOCUMENTS

| | | | |
|---|---|---|---|
| 925056 | 4/1973 | Canada | 206/205 |
| 0093796 | 11/1873 | European Pat. Off. . | |
| 2904042 | 8/1980 | Fed. Rep. of Germany | 206/587 |
| 248678 | 10/1988 | Japan | 206/524.8 |
| 226575 | 9/1989 | Japan | 206/205 |
| 1485832 | 9/1977 | United Kingdom . | |
| 2208287 | 3/1989 | United Kingdom . | |

*Primary Examiner*—William I. Price
*Attorney, Agent, or Firm*—Frishauf, Holtz, Goodman & Woodward

[57] ABSTRACT

A hardly gas permeable and airtightly sealed package encloses a container containing infusion. The package also encloses an amount of deoxidizing agent. The package comprises a hardly deformable tray and a flexible lid bonded to the flange of said tray. The container comprises a discharge port, a container main body and a neck connecting said port and said main body. A jagged or irregular portion having a profile corresponding to that of the port and neck is integrally formed with the tray. The irregular portion controls the movement of the container relative to the package.

17 Claims, 2 Drawing Sheets

PACKAGED ARTICLE

BACKGROUND OF THE INVENTION

1. Field of the Invention

This invention relates to a packaged article and, more particularly, it relates to a packaged article to be suitable used for storing infusion that contains oxygen degradable substances such as amino acids with the passage of time under stable conditions.

2. Description of the Related Art

Transfusion, or drip transfusion, is a therapeutic technique to be used for administering a large quantity of liquid medicine to the patient through a vein. Infusions used for transfusion typically include nutrient solutions designed to cause nutrients to be taken into the patient in a non-intestinal way, electrolyte solutions designed to cure the dehydration and improve the humor of the patient and plasma booster solutions designed to maintain the blood pressure of the patient during a surgical operation.

Of these infusions, sugar solutions, amino acid solutions, fat emulsions are among the most popular ones.

Any of these infusions are used for improving the physical strength of the patient during and after the surgical operation and often show a remarkable effect particularly when the patient is not capable of ingesting foods per-intestine.

Amino acid solutions used for transfusion normally contain essential amino acids and quasi-essential amino acids as well as non-essential amino acids prescribed to show a composition that facilitates intake by the human body and can be categorized into several groups including one based on the amino acids found in human milk. Nutrient solutions prepared by adding one or more than one sugar alcohols such as xylitol or electrolytes to amino acid solutions are also popularly used.

A fat emulsion is in fact an O/W type emulsion prepared by adding a physically permissible emulsifier to one or more than one kinds of vegetable oil such as soybean oil. Therefore, it normally contains as nutritious ingredients palmitic acid, stearic acid and other saturated fatty acids as well as oleic acid, linoleic acid, linolenic acid and other unsaturated fatty acids. Fat emulsions additionally containing unsaturated fatty acids that are important but not found in vegetable oils such as eicosapentaenoic acid and docosahexaenoic acid are also gaining popularity.

Infusions as described above are conventionally contained in medical containers such as vials, synthetic resin bottles and synthetic resin film bags for ease of distribution and use.

While each of these containers has its own advantages and disadvantages, a synthetic resin film bag or a synthetic resin bottle may be recommendable as it is less expensive and practically free from damages during transportation.

Synthetic resin materials to be used for infusion containers need to meet the following requirements;

(1) not permeable to liquid, (2) capable of completely blocking invasion of microorganisms from outside, (3) having sufficient mechanical strength if used for infusion containers, (4) sufficiently heat-resistive if heated for sterilization and (5) free from problems due to exudation.

Polyvinyl chloride and crosslinked ethylene-vinyl acetate copolymer resin (crosslinked EVA resin) are among popularly used synthetic resin materials that meet the above requirements.

Solutions containing amino acids, electrolytes and/or sugar alcohols and fat emulsions as described above are accompanied by a problem of being colored brown (hereinafter referred to as browning) during storage to lose totally or partly their commercial values.

Browning occurs when any of the ingredients of a solution are chemically affected by oxygen existing in the solution. Therefore, browning is not only a problem of appearance but a problem of reducing the concentration of amino acids and fats in the solution and producing chemicals that may adversely affect the human body. Browning can also be observed in fat emulsions, where unsaturated fatty acids contained in them are decomposed with time to produce peroxides and thereafter aldehydes, ketones or carboxylic acids, giving rise to problems such as reduction in the pH level.

The problem of browning becomes particularly remarkable when synthetic resin bottles or bags are used for containers. This is because synthetic resins used as materials for bottles and bags such as vinylchloride resins and cross linked EVA resins possess a certain degree of gas permeability and therefore oxygen molecules in air can get into the infusions contained in the bottles and bags to increase the concentration of dissolved oxygen. This is a phenomenon that vials are exempted from.

In an attempt to avoid the problem of gas permeability, there has been proposed a hardly gas permeable sack prepared by laying a pair of polyester resin sheets together, vapor depositing aluminum on the opposite surfaces and heat-sealing the periphery of the sheets by means of a hot-melt type adhesive so that it may hermetically enclose a synthetic resin bottle or bag.

However, a sack as described above is accompanied by certain problems. Firstly, it is inconvenient for storing because it is deformable. Secondly, it can be flattened when placed under a heavy load during storage or transportation and adversely affect the item contained in it. Thirdly, the item contained in it can become shaky and displaced during haulage and eventually damage the sealed area of the sheets to produce pin holes or separation of sheets, which by turn ruin the airtightness of the sack.

SUMMARY OF THE INVENTION

In view of this problem, it is therefore an object of the present invention to provide a packaged article that ensures an inside product to be kept free from displacement even if it is subjected to vibrations and shaky motions during transportation and therefore not to apply any significant shocks to the package that can produce pin holes, cracks and separations of parts in the package.

Another object of the present invention is to provide a packaged article that can keep the inside practically under a deoxidized condition so that a product contained in it may be kept unchanged and stable with the passage of time even if the product is oxygen degradable.

The inventors of the present invention have proposed a hardly deformable and hardly gas permeable package realized in the form of a deep tray to encase an infusion container containing amino acids and other useful substances along with deoxidizer, the top opening of said deep tray being hermetically sealed by a hardly gas permeable film.

With such an arrangement, since the oxygen in the tray-like package and that dissolved in the solution within the container are absorbed by the deoxidizer and since the sealed article is hardly permeable to gas, the inside of the container is protected against external oxygen and keeps a deoxidized condition.

It has been found, however, that a hardly deformable and relatively hard tray-like package as described above can give rise to a problem of separation of the sealing film and losing its airtightness during transportation where the infusion container is subjected to vibrations and shaky motions or when it is let fall down to collide on the floor as there is a considerable space between the inside of the package and the infusion container and the latter can be easily displaced to hit and push up the sealing film at the top of the tray to expose the container to air when the tray is shaken very hard.

According to a first aspect of the present invention, there is provided a packaged article comprises a hardly deformable tray made of a laminated sheet comprising polyolefine outer and inner layers and a hardly gas permeable middle layer, and provided with a flange arranged along the edge of an opening, a flexible lid made of a laminated sheet comprising outer and inner layers and a hardly gas permeable middle layer, and airtightly bonded to said flange of said tray to form a hardly gas permeable package, said inner layer of said lid being made of a synthetic resin material which is bonded to said inner layer of said tray by a heat sealing operation, while said outer layer of said lid being made of a synthetic resin material which withstands the heat during said heat sealing operation, a product enclosed in said package, and control means for controlling the movement of said product relative to said package.

According to a second aspect of the present invention, there is provided a package article according to the first aspect, wherein said product contains oxgen degradable substances, and an amount of deoxidizing agent is enclosed in said package.

Said means for controlling the movement of said product relative to said package preferably is a stopper having a form that corresponds to the outer shape of said product.

The package of a packaged article according to the invention is designed to encase a container containing oxygen degradable substances such as amino acids dissolved in infusion. In other words, the product of the packaged article is preferably an infusion container.

Said means for controlling the movement of the product relative to the package, preferably a stopper, protects the product against any undesirable displacement from its proper packaged position that may occur during transportation to give a great impact to the package and produce pin holes, cracks and separations of parts in the latter.

Therefore, the inside of the package is kept in an oxygen free or low oxygen condition by the deoxidizing agent encased in it and the substances contained in the product can be stored with the passage of time under stable conditions without degradation even if they are oxygen degradable.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention and, together with the general description given above and the detailed description of the preferred embodiments given below, serve to explain the principles of the invention.

DETAILED DESCRIPTION OF THE PREFERRED EMBODIMENT

Now, the present invention will be described by referring to the accompanying drawings that illustrate preferred embodiments of the invention.

Figure 1:
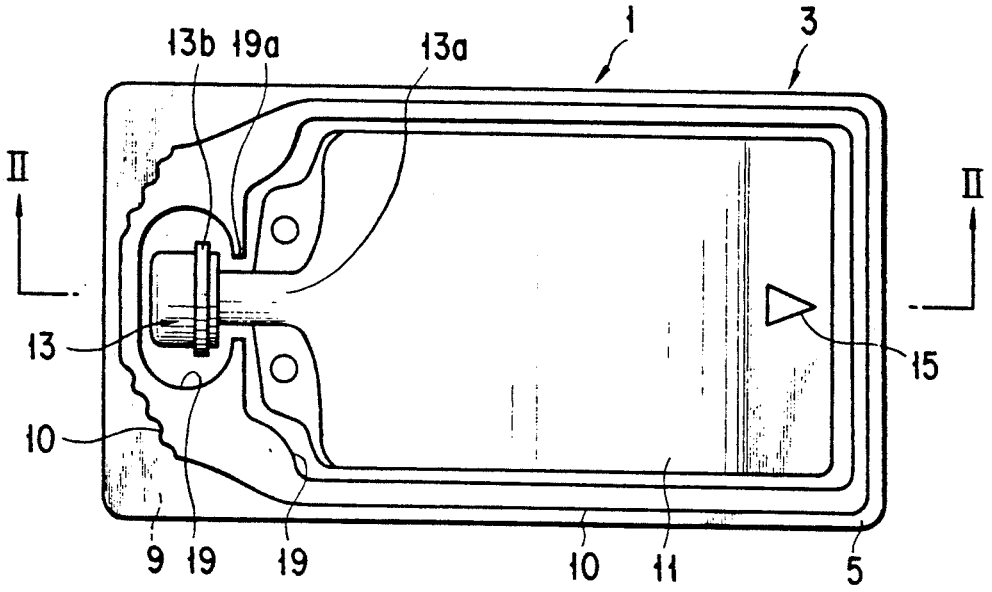
FIG. 1 is a plan view of a first embodiment of the invention.
Figure 2:
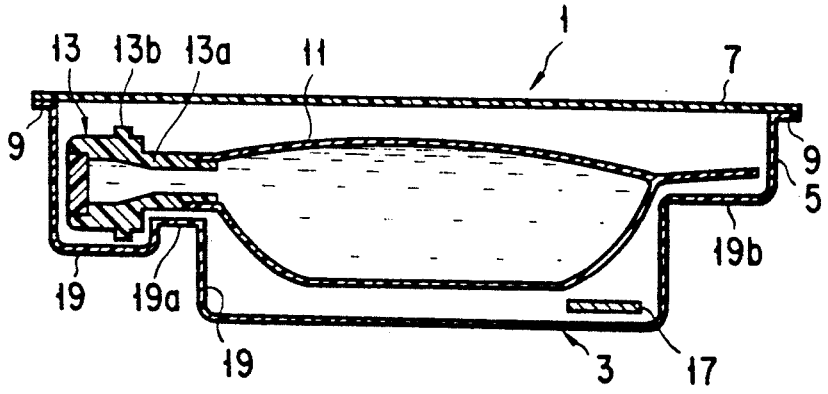
FIG. 2 is a sectional view of the first embodiment cut along II—II line of FIG. 1.

Referring firstly to FIGS. 1 and 2 illustrating a first preferred embodiment of the invention, a packaged article 1 comprises as a principal component a package 3 which is constituted by a deep tray 5 and a thin lid 7 for closing and sealing the top opening of the tray 5.

The deep tray 5 is prepared by molding a laminated sheet comprising a polyolefine outer layer, a hardly gas permeable middle layer and a polyolefine inner layer and having a thickness of approximately 400 to 600 82 m, using upper and lower metal molds, and provided with a flange 9 arranged along the edges of the top opening.

The polyolefine that constitutes the material for the outer and inner layers of the tray 5 may be polypropylene or polyethylene, although polypropylene is preferable because of its excellent resilience and heat-resistivity.

The hardly gas permeable middle layer of the tray 5 is preferably made of an ethylene-vinylalcohol copolymer or polyvinylidene chloride.

The layer of polyvinylidene chloride is sandwiched by a pair of film layers of a polyolefine, preferably biaxially drawn (oriented) polypropylene. The gas permeability of the tray may be further reduced by using a multi-layered polyolefine film for the middle layer.

The tray 5 prepared in this way preferably has an oxygen permeability of less than 1.0 cc/m$^2$/24 hrs at 20° C. and a relative humidity of 60%.

On the other hand, the lid 7 is prepared by laminating an outer layer made of a material that can withstand a heat sealing operation, a hardly gas permeable middle layer and an inner layer of hot-melt type adhesive agent.

Materials that can be used for the outer layer of the lid 7 and withstand a heat sealing operation include polyesters such as polyethylene terephthalate and polybutylene terephthalate, polyamides such as nylon and polypropylenes, of which polyethylene terephthalate is preferably used.

Materials that can be used for the hardly gas permeable middle layer of the lid 7 include ethylenevinylalcohol copolymers and polyvinylidene chloride as in the case of the middle layer of the tray 5.

The layer of polyvinylidene chloride is placed between the outer and inner layers of polyolefine films, preferably biaxially drawn polypropylene films. Again, the gas permeability of the lid may be further reduced by using a multi-layered polyolefine film for the middle layer.

The lid 7 prepared in this way preferably has an oxygen permeability of less than 1.0 $cc/m^2/24$ hrs at 20° C. and a relative humidity of 60%.

Materials that can be used for the inner layer of hot-melt type adhesive agent of the lid 7 include nonoriented polypropylene and a mixture of polyethylene and polypropylene.

When a mixture of polyethylene and polypropylene is used for the inner layer of the lid 7, the ratio by weight of polyethylene to polypropylene in the mixture is preferably between 20:80 and 50:50 from the view point of heat-sealing effect and peel-openability.

If the adhesive agent of the inner layer of the lid 7 contains a material having a strong affinity to the polyolefine of the corresponding inner layer of the tray 5 to an excessively large extent, it may show a poor peel-openability when the lid 7 is to be taken away from the tray. If, on the other hand, it contains such a material only to an extremely low degree, it will hardly adhere to the corresponding inner layer of the tray 5. The multi-layered lid 7 has a thickness between 80 and 150 μm.

The strength of the lid 7 can be improved by arranging an additional polyamide layer, a nylon layer for instance, between the inner and middle layers.

The flange 9 of the tray and the hot-melt type adhesive layer arranged at least at and near the peripheral edges of the inner layer of the lid 7 are bonded together along a sealing line 10 by heat-sealing using metal molds to hermetically seal the package 3.

The lid 7 preferably has a certain degree of flexibility. This is because the inside of the package article 1 turns to show a negative pressure with the passage of time after the package 3 is sealed, since the oxygen inside the package is gradually absorbed by the deoxidizing agent or oxygen adsorbent 17, which will be described later, and therefore, if the lid 7 is flexible, it is deflected downward at the center toward the bottom of the tray 5 to press hard the infusion container enclosed in it downward to hold it firmly and protect it against any possible displacement.

The product encased in said package 3 is typically an infusion container 11 containing an infusion to be used for transfusion.

A typical infusion is an amino acid solution. Amino acids used for transfusion include L-isoleucine, L-leucine, L-lysine, L-methionine, L-phenylalanine, L-threonine, L-valine, L-tyrosine, L-triptophan, L-arginine, L-histidine, L-alanine, L-asparagic acid, amino acetic acid, L-proline and L-serine. Any of these amino acids may be used independently or in combination with other appropriate amino acids. Sugar alcohol such as xylitol or sorbitol may be added thereto.

Fat emulsions also provide materials for transfusion. Fatty ingredients for fat emulsions include vegetable oils such as soybean oil and safflower oil, unsaturated fatty acids such as linolic acid, linolenic acid, eicosapentaenoic acid and docosahexaenoic acid, esters of these unsaturated fatty acids such as triglycerides and alkylesters, refined fish oils such as sardine oil and cod oil and other lipidic substances good for intravenous administration. Emulsifiers to be used for suspending these fatty ingredients in water include refined yoke lecithin and refined soybean lecithin.

The infusion container 11 for containing a solution or fat emulsion may be an ordinary bottle or bag made of polyvinylchloride resin or crosslinked ethylene-vinyl acetate copolymer resin (crosslinked EVA resin).

The infusion container 11 illustrated in FIGS. 1 and 2 is prepared by bonding a pair of sheets or a flat tube produced by inflation molding to form a container having a desired shape and provided at an end with a hard and pipe-shaped discharge port 3 made of high density polyethylene or polypropylene and having a rubber plug arranged at the remote end.

Said infusion container 11 is also provided at the other end with a suspender through bore 15 to be used for receiving a suspender for the container 11.

The infusion container 11 having a configuration as described above is housed and laid flat in the package 3 as best seen from in FIG. 2.

An amount of deoxidizing agent 17 is arranged under the bottom of the infusion container 11.

The deoxidizing agent may be appropriately selected from commercially available deoxidizing agents that can absorb oxygen. Examples of such deoxidizing agents include the following.

(1) a piece of a compound or a mixture of compounds selected from iron carbide, iron carbonyl, iron monoxide, iron hydroxide and iron silicide and coated with metal halogenide.

(2) a mixture of dithionous acid salt and a compound or mixture selected from hydroxides or carbonates of alkaline earth metals, a mixture of active carbon and water, compounds containing water of crystallization, alkaline substances and alcoholic compounds.

(3) a mixture of sulfite of an alkaline earth metal and a compound selected from ferrous compounds, salts of transition metals, aluminum salts, alkaline compounds containing an alkali metal or an alkaline earth metal, alkaline compounds containing nitrogen and ammonium salts.

(4) a mixture of either Fe or Zn and $Na_2SO_4.H_2O$.

(5) a mixture of either Fe or Zn, $Na_2SO_4H_2O$ and a metal halogenide.

(6) a mixture of Fe, Cu, Sn, Zn or Ni, $Na_2SO_4.7H_2O$ and a metal halogenide.

(7) a mixture of Fe, Cu, Sn, Zn or Ni, $Na_2SO_4.10H_2O$ and a metal halogenide.

(8) a mixture of a transition metal of the fourth period in the periodic table, Sn or Sb and water.

(9) a mixture of a transition metal of the fourth period in the periodic table, Sn or Sb, water and a metal halogenide.

(10) a mixture of sulfite of an alkali metal or ammonia, water solution of sulfurous acid or pyrosulfite, a salt of a transition metal or aluminum and water.

The deoxidizing agent selected from the above list is preferably placed in a small and gas permeable bag. When the agent is tableted, it may be used without a bag.

A means for controlling the movement of said infusion container 11 in the package 3 during transportation is arranged in the tray 5 in order to suppress any undesirable movement of the container 11 such as vibration, rocking motion and displacement.

Any control means may be used for the purpose of the present invention so long as it can effectively control the movement of the infusion container 11.

FIGS. 1 and 2 show a stopper, or holder, 19 appropriately configured to accommodate at least part of the product enclosed in the package.

The stopper 19 does not necessarily have to be shaped to show a profile similar to that of the product to be accommodated in it and it may be sufficient for it to have a jagged or irregular profile to catch and hold a corresponding portion of the product enclosed in the package.

What is essential here is that it can tightly receive a corresponding portion of the product enclosed in the package so that it may effectively control the movement of the latter.

The stopper 19 shown in FIGS. 1 and 2 is designed to hold the discharge port 13 of the infusion container 11 in the tray 5 as the discharge port 13 can be easily held from outside. Note that the stopper 19 has an annular projection 19*a* fitting in the neck 13*a* of the discharge port 13 to effectively hold the container 11.

The cap 13*b* of the discharge port 13 has a diameter slightly greater than the inner diameter of the annular projection 19*a* so that the cap 13*b* is firmly held by the annular projection 19*a* that blocks any displacement of the container 11.

The stopper 19 may be integrally molded with the tray by using upper and lower metal molds.

The portion 19*b* of the stopper 19 that faces the sheet-like thin portion of the infusion container 11 where the suspender through bore 15 is formed is raised to eliminate any unnecessary space.

Thus, the stopper 19 integrally formed with the tray 5 inside the tray 5 has a profile very close to that of the infusion container 11 to be enclosed in the package 3 so that unnecessary space may be eliminated as much as possible and consequently the infusion container 11 may be advantageously protected against displacement and shaky movement during transportation.

Figure 3:
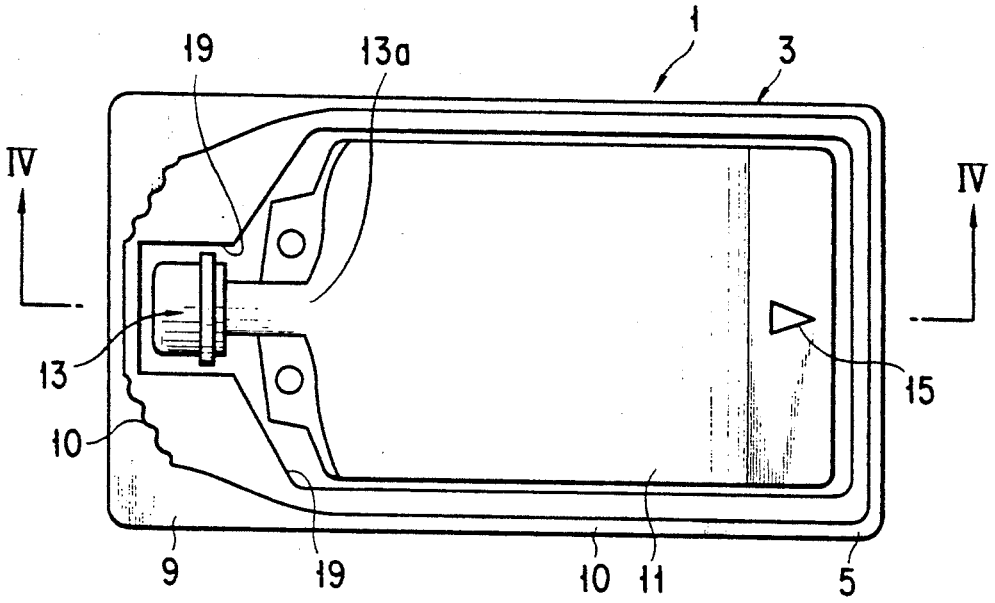
FIG. 3 is a plan view of a second embodiment of the invention.
Figure 4:
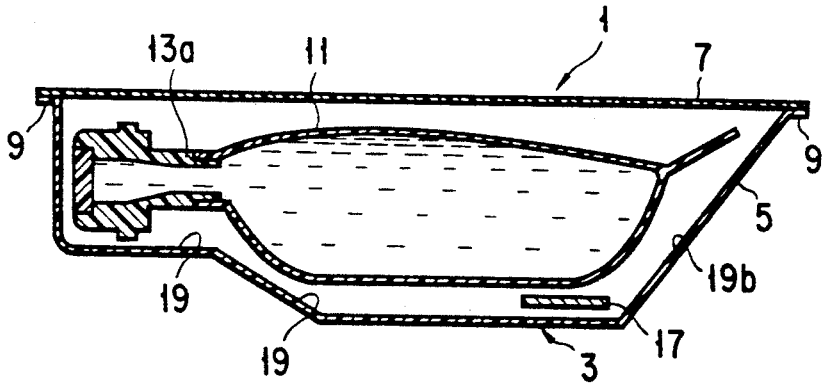
FIG. 4 is a sectional view of the second embodiment cut long IV—IV line of FIG. 3.

The second embodiment of the invention illustrated in FIGS. 3 and 4 differs from the first embodiment only in that it has a stopper 19 somewhat different from that of the first embodiment.

Unlike the stopper 19 of the first embodiment, the stopper 19 of this embodiment does not have an annular projection 19*a* that fits in the neck 13*a* of the discharge port 13 of the infusion container 11. Nor has it a raised portion 19*b* as in the case of the first embodiment but a gentle slope.

This second embodiment is the same as the first embodiment for the rest.

Since this embodiment also comprises a stopper 19 having a configuration corresponding to that of the infusion container 11, the container 11 may be advantageously protected against displacement and shaky movement within the package 3 while the packaged article 1 is transported.

Now, the present invention will be described in further by way of examples.

EXAMPLE 1

A container made of a crosslinked ethylenevinylacetate copolymer resin material was filled with a 520 ml of water solution containing amino acid by approximately 12 w/v% to be used for transfusion. After sealing the bag, the solution was sterilized in an autoclave containing vapor under high pressure.

After cooling the solution, the container was taken out of the autoclave and cleaned to remove any moisture from its surface. Thereafter, it was put into a package to take a position as shown in FIG. 1.

The lid of the package was prepared by forming a flexible multi-layered laminate having a thickness of approximately 100 μm and comprising an outer layer of polyethylene terephthalate, a layer of ethylene-vinylalcohole copolymer, a layer of nylon and a layer of non-drawn (-oriented) polypropylene arranged in this order.

On the other hand, the tray for accommodating the container was prepared by forming a multi-layered laminate having a thickness of approximately 400 to 600 μm and comprising an outer layer of polypropylene, a layer of ethylene-vinylalcohole copolymer and another layer of polypropylene arranged in this order. The tray was provided with a recess as shown in FIGS. 1 and 2.

An amount of an deoxidizing agent (trade name "Ageless FX-200" available from Mitsubishi Gas Chemical Company, Inc.) and the infusion container were placed in the tray and the tray and the lid were bonded together by performing a heat-sealing operating along the flange of the tray to produce a finished packaged article.

EXAMPLE 2

A packaged article similar to that of Example 1 above was prepared, the only difference being the shape of the tray, the tray of this example being the same as the one shown in FIG. 3.

COMPARATIVE EXAMPLE

An infusion container containing a solution identical with that of Example 1 and a same amount of the deoxidizing agent used in Example 1 were placed between a pair of laminate films, each having a thickness of approximately 115 μm and prepared by arranging an outer layer of nylon, a layer of ethylene-vinylalcohole copolymer, another layer of nylon and a layer of straight chain low density polyethylene in this order. Thereafter, the laminate films were bonded together along the four edges to produce a rectangular packaged article.

COMPARATIVE TEST

Each of the packaged articles of Examples 1 and 2 and Comparative Example was subjected to a durability test against vibrations and impacts.

A same number of identical samples of the packaged article of each of the above examples were prepared and each of the samples was encased in a rectangular cardboard unit case which was open at a pair of opposite ends and then twenty unit boxes filled with the samples were arranged in a corrugated cardboard box in two layers, each layer having ten cardboard cases.

Each of the corrugated cardboard boxes that contained a same number of unit cases was subjected to a vibration test (5G×1 hr, vertical vibration) and a drop test (90 cm×7 times) and the number of pin holes and the number of separations of the bonded area of the samples were checked after the tests.

Table 1 below shows the result of the tests.

In any of the above examples, the number of tested samples was n=60 (arranged in three corrugated boxes).

TABLE 1

| | Number of Pin Holes and Separations | |
|---|---|---|
| | vibration test (5 G × 1 hr) | drop test (90 cm × 7 times) |
| Example 1 | 0 | 0 |

TABLE 1-continued

| | Number of Pin Holes and Separations | |
|---|---|---|
| | vibration test (5 G × 1 hr) | drop test (90 cm × 7 times) |
| Example 2 | 0 | 2 |
| Comparative Example | 2 | 2 |

From the above table, it was proved by the vibration test and the drop test that samples of the packaged article according to the invention were by far more vibration resistive and shock resistive than the samples of Comparative Example.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A packaged article comprising:

a substantially non-deformable tray formed of a laminated sheet comprising polyolefine outer and inner layers and a substantially non-gas permeable middle layer provided between said outer and inner layers, said tray being provided with a flange portion arranged along an edge of an opening;

a flexible lid formed of a laminated sheet comprising outer and inner layers and a substantially non-gas permeable middle layer provided between said inner and outer layers of said flexible lid, said flexible lid being airtightly bonded to said flange portion of said tray to form a substantially non-gas permeable sealed package, said inner layer of said lid being made of a synthetic resin material that is heat sealable to said inner layer of said tray, said outer layer of said lid being formed of a synthetic resin material that is capable of withstanding a heat generated during a heat sealing of said inner layer of said tray to said inner layer of said lid;

a container enclosed in said sealed package, said container comprising a discharge port having a cap mounted thereon, a container main body and a neck connecting said discharge port and said main body;

a liquid contained in said container; and control means for preventing a movement of said container relative to said sealed package, said control means comprising a projection portion protruding into an inside portion of said package, so as to decrease an interior dimension of said package adjacent said neck of said container;

said projection portion being formed integrally with said tray, and being arranged to fit with a shape of said neck of said container; and wherein said projection portion defines a constricted portion of said sealed package so that said constricted portion of said sealed package is dimensionally smaller than a diameter of said cap.

2. The packaged article according to claim 1, wherein said projection portion has an annular shape, an inner diameter of said annular shape of said projection portion being smaller than said diameter of said cap.

3. The packaged article according to claim 1, wherein:

said container comprises a sheet-like thin portion provided at an end portion of said container that is positioned to be opposite to said discharge port; and said control means comprises a portion facing said sheet-like thin portion of said container that is formed integrally with said tray by raising a part of a bottom portion of said tray.

4. A packaged article according to claim 1, wherein said liquid contained in said container is an infusion liquid.

5. A packaged article according to claim 1, wherein said inner layer of said lid is separable from said inner layer of said tray, after having been sealed thereto.

6. A packaged article comprising:

a substantially non-deformable tray formed of a laminated sheet comprising polyolefine outer and inner layers and a substantially non-gas permeable middle layer provided between said inner and outer layers, said tray being provided with a flange portion arranged along the edge of an opening;

a flexible lid formed of a laminated sheet comprising outer and inner layers and a substantially non-gas permeable middle layer provided between said inner and outer layers of said flexible lid, said flexible lid being airtightly bonded to said flange portion of said tray to form a substantially non-gas permeable sealed package, said inner layer of said lid being formed of a synthetic resin material that is heat sealable to said inner layer of said tray, said outer layer of said lid being formed of a synthetic resin material that is capable of withstanding a heat generated during a heat sealing of said inner layer of said tray to said inner layer of said tray;

a container enclosed in said sealed package, said container comprising a discharge port having a cap mounted thereon, a container main body and a neck connecting said discharge port and said main body;

a liquid having oxygen degradable substances as ingredients therein, said liquid being contained in said container;

a deoxidizing agent enclosed in said package; and control means for preventing a movement of said container relative to said sealed package, said control means comprising a projection portion protruding into an inside portion of said package so as to decrease an interior dimension of said package adjacent said neck of said container, said projection portion being formed integrally with said tray and being shaped to fit with a shape of said neck of said container; and wherein said projection portion defines a constricted portion of said sealed package so that said constricted portion of said sealed package is dimensionally smaller than a diameter of said cap.

7. The packaged article according to claim 6, wherein said projection portion has an annular shape; and an inner diameter of said annular shape of said projection portion being smaller than said diameter of said cap.

8. The packaged article according to claim 6, wherein:

said container comprises a sheet-like thin portion provided at an end portion of said container that is positioned to be opposite to said discharge port; and said control means comprises a portion facing said sheet-like thin portion of said container that is formed integrally with said tray by raising a part of a bottom portion of said tray.

9. The packaged article according to claim 6, wherein said liquid contained in said container is an infusion liquid.

10. A packaged article according to claim 6, wherein said inner layer of said lid is separable from said inner layer of said tray after having been sealed thereto.

11. A packaged article comprising:

a substantially non-deformable tray formed of a substantially non-gas permeable resin sheet, said tray being provided with a flange portion arranged along an edge of an opening;

a flexible lid formed of a substantially non-gas permeable resin sheet and airtightly bonded to said flange portion of said tray to form a substantially non-gas permeable sealed package;

a container enclosed in said sealed package, said container comprising a discharge port having a cap mounted thereon, a container main body and a neck connecting said discharge port and said main body;

a liquid contained in said container; and control means for preventing a movement of said container relative to said package, said control means comprising a projection portion protruding into an inside portion of said package so as to decrease an interior dimension of said package adjacent said neck of said container;

said projection portion being formed integrally with said tray, and being shaped to fit with a shape of said neck of said container; and wherein said projection portion defines a constricted portion of said sealed package so that said constricted portion of said sealed package is dimensionally smaller than a diameter of said cap.

12. The packaged article according to claim 11, wherein said projection portion has an annular shape, an inner diameter of said annular shape of said projection portion being smaller than said diameter of said cap.

13. The packaged article according to claim 11, wherein:

said container comprises a sheet-like thin portion provided at an end portion of said container that is positioned to be opposite to said discharge port; and said control means comprises a portion facing said sheetlike thin portion of said container that is formed integrally with said tray by raising a part of a bottom portion of said tray.

14. The packaged article according to claim 11, wherein said liquid contained in said container is an infusion liquid.

15. A packaged article comprising:

a substantially non-deformable tray formed of a sheet and provided with a flange portion arranged along an edge of an opening;

a flexible lid formed of a sheet and airtightly bonded to said flange portion of said tray to form a substantially non-gas permeable sealed package;

a container enclosed in said sealed package, said container comprising a discharge port having a cap mounted thereon, a container main body and a neck connecting said discharge port and said main body;

an infusion liquid contained in said container; and control means for preventing a movement of said container relative to said sealed package, said control means comprising a projection portion protruding into an inside portion of said package, so as to decrease an interior dimension of said sealed package adjacent to said neck of said container, said projection portion being formed integrally with said tray, and arranged to fit with a shape of said neck of said container; and wherein said projection portion defines a constricted portion of said sealed package so that said constricted portion of sealed container is dimensionally smaller than a diameter of said cap.

16. The packaged article according to claim 15, wherein said projection portion has an annular shape, an inner diameter of said annular shape of said projection being smaller than said diameter of said cap.

17. The packaged article according to claim 15, wherein:

said container comprises a sheet-like thin portion provided at an end portion of said container that is positioned to be opposite to said discharge port; and said control means comprises a portion facing said sheet-like thin portion of said container that is formed integrally with said tray by raising a part of a bottom portion of said tray.

* * * * *